US009014612B2

(12) United States Patent
Matsumura

(10) Patent No.: US 9,014,612 B2
(45) Date of Patent: Apr. 21, 2015

(54) CLEANING DEVICE AND IMAGE FORMING APPARATUS

(71) Applicant: Canon Kabushiki Kaisha, Tokyo (JP)

(72) Inventor: Takuya Matsumura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 13/721,325

(22) Filed: Dec. 20, 2012

(65) Prior Publication Data

US 2013/0189011 A1 Jul. 25, 2013

(30) Foreign Application Priority Data

Jan. 25, 2012 (JP) ..... 2012-012932

(51) Int. Cl.
*G03G 21/00* (2006.01)

(52) U.S. Cl.
CPC ..... *G03G 21/0029* (2013.01)

(58) Field of Classification Search
USPC ..... 399/75, 345, 350, 351
See application file for complete search history.

(56) References Cited

U.S. PATENT DOCUMENTS

| | | | |
|---|---|---|---|
| 5,678,139 | A | 10/1997 | Nomura et al. |
| 2002/0025181 | A1 | 2/2002 | Meguro |

FOREIGN PATENT DOCUMENTS

| | | | |
|---|---|---|---|
| CA | 2121981 | C | 1/2000 |
| CN | 1097867 | A | 1/1995 |
| EP | 0622699 | B1 | 2/2003 |
| GB | 2277486 | A | 11/1994 |
| JP | 2001-228775 | A | 8/2001 |

OTHER PUBLICATIONS

Jan. 14, 2015 Chinese Office Action concerning Chinese Patent Application No. 201310023083.1.

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A representative configuration of a cleaning device and an image forming apparatus according to the present invention includes: a photosensitive drum which bears a toner image; a cleaning blade which abuts against the photosensitive drum and removes a toner remained in the photosensitive drum; a compression coil spring which is compressed to pressurize the cleaning blade against the photosensitive drum; and a positioning boss which is arranged to face the compression coil spring, with a predetermined gap being provided therebetween, allows a movement in a direction perpendicular to a compression direction of the compression coil spring, and regulates a movement of the compression coil spring such that the compression coil spring is not moved by more than a predetermined amount in the direction perpendicular to the compression direction of the compression coil spring.

4 Claims, 6 Drawing Sheets

CLEANING DEVICE AND IMAGE FORMING APPARATUS

BACKGROUND OF THE INVENTION

1. Field of the Invention

The present invention relates to a cleaning device which cleans an image forming apparatus or an intermediate transfer member, and an image forming apparatus including the same.

2. Description of the Related Art

Some of cleaning devices used for image forming apparatuses, such as printers, copying machines, and facsimile machines, include a cleaning blade (cleaning member) which cleans an image bearing member or an intermediate transfer member.

For example, in an image forming apparatus using an electrophotographic system, a toner image is primarily transferred from a photosensitive drum (image bearing member) to an intermediate transfer belt (intermediate transfer member), and is secondarily transferred from the intermediate transfer belt to a sheet. At the time of the transfer, a small amount of toner remains in the photosensitive drum or the intermediate transfer belt. The toner remained in the photosensitive drum or the intermediate transfer belt (hereinafter, referred to as residual toner) is removed by the above-described cleaning blade.

In the cleaning device using the cleaning blade, it is necessary to pressurize the cleaning blade against the photosensitive drum. However, in a case where the pressure of the cleaning blade is changed, there arises a problem in that the cleaning blade is bent back or the residual toner is taken out by a poor cleaning.

Therefore, there is proposed a configuration in which a compression coil spring is provided on a back side of a cleaning blade, and a pressure of the cleaning blade is constantly applied to a photosensitive drum by using a pressure of the compression coil spring (Japanese Patent Laid-Open No. 2001-228775 (Patent Literature 1)).

As described in Patent Literature 1, when the cleaning blade is pressurized by the compression coil spring, the compression coil spring needs to be positioned by some unit. As the positioning unit, a configuration which press-fits a compression coil spring into a commonly used positioning boss may be considered. In this case, in a portion where the compression coil spring and the positioning boss are engaged with each other by press-fit, the compression coil spring generates no pressure. Hence, a desired pressure cannot be obtained. Also, in a case where the positioning member is provided on not a cleaning blade side but a container side, a position being spring-pressurized is changed by the posture of the blade. Therefore, it is difficult to stably apply a pressure.

SUMMARY OF THE INVENTION

In a cleaning device which pressurizes a swingably supported cleaning blade by a compression spring, it is desirable to provide a cleaning device and an image forming apparatus capable of suppressing a change in pressure, which is caused because a pressure position is not constant according to a swing position of a blade.

In order to solve the above problems, a cleaning device and an image forming apparatus according to the present invention have the following representative configurations. The cleaning device includes: a blade which abuts against an image bearing member bearing a toner image, and removes a toner remained in the image bearing member; a supporting member which supports the blade; a cleaning container which swingably supports the supporting member; a pressurizing member which is compressed to pressurize the supporting member; and a regulating portion which is provided in the supporting member, is arranged to face the pressurizing member, with a predetermined gap being provided therebetween, allows a movement in a direction perpendicular to a compression direction of the pressurizing member, and regulates a movement of the pressurizing member such that the pressurizing member is not moved by more than a predetermined amount in the direction perpendicular to the compression direction. The image forming apparatus includes: the image bearing member which bears an electrostatic latent image; and the cleaning device which cleans the image bearing member.

Further features of the present invention will become apparent from the following description of exemplary embodiments with reference to the attached drawings.

DESCRIPTION OF THE EMBODIMENTS

First Embodiment

Figure 2:
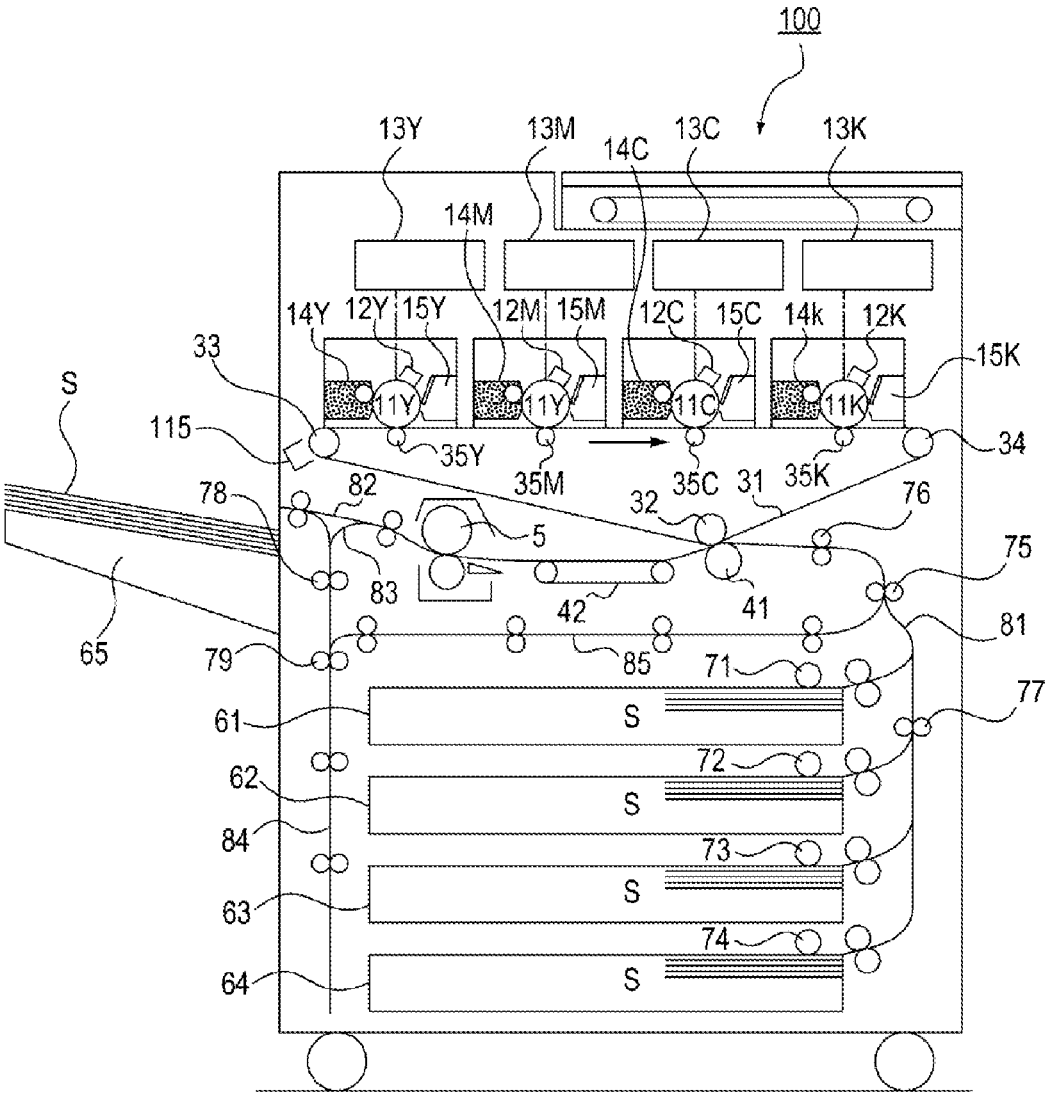
FIG. 2 is a configuration diagram of an image forming apparatus according to the first embodiment.

A first embodiment of a cleaning device and an image forming apparatus according to the present invention will be described with reference to the drawings. FIG. 2 is a configuration diagram of an image forming apparatus according to the present embodiment.

As illustrated in FIG. 2, in an image forming apparatus 100 of the present embodiment, electrostatic latent images are formed in such a manner that photosensitive drums (image bearing members) 11Y to 11K, of which surfaces are uniformly charged by charging devices 12Y to 12K, are exposed to a laser according to image information by exposure devices 13Y to 13K.

The electrostatic latent images formed on the photosensitive drums 11 are developed into toner images using respective color toners by developing devices 14Y to 14K. The respective developed color toner images are primarily transferred by primary transfer rollers 35Y to 35K, while being overlapped on an intermediate transfer belt (intermediate transfer member as an image bearing member) 31. The intermediate transfer belt 31 is rotatably suspended in a secondary transfer inside roller 32, a driving roller 33, and a tension roller 34. The residual toner remained slightly on the photosensitive drums 11 after the primary transfer is collected by the cleaning devices 15Y to 15K in preparation for next image formation.

On the other hand, sheets S accommodated in cassettes 61 to 64 are fed by pickup rollers 71 to 74, and are conveyed to a secondary transfer portion through a conveying path 81 by a conveying roller 75 and a pair of registration roller 76. The secondary transfer portion is a nip portion between the secondary transfer inside roller 32 and a secondary transfer outside roller 41 through the intermediate transfer belt 31, with respect to the toner image primarily transferred on the intermediate transfer belt 31.

The toner image on the intermediate transfer belt 31 is secondarily transferred on the sheet S conveyed to the secondary transfer portion, and the sheet S is conveyed to a fixing device 5 by a conveying apparatus 42. The sheet S conveyed to the fixing device 5 is heated and pressurized to fix the toner image thereon, and is discharged to a discharge tray 65 through a discharge conveying path 82. The residual toner remained slightly on the intermediate transfer belt 31 after the secondary transfer is collected by a cleaning device 115 in preparation for next image formation.

Also, when an image is formed on two sides of the sheet S, the sheet S is conveyed by reversing rollers 78 and 79, and is reconveyed to the secondary transfer portion in a reverse state through a reversal guidance path 83, a switchback path 84, and a duplex conveying path 85.

Figure 1:
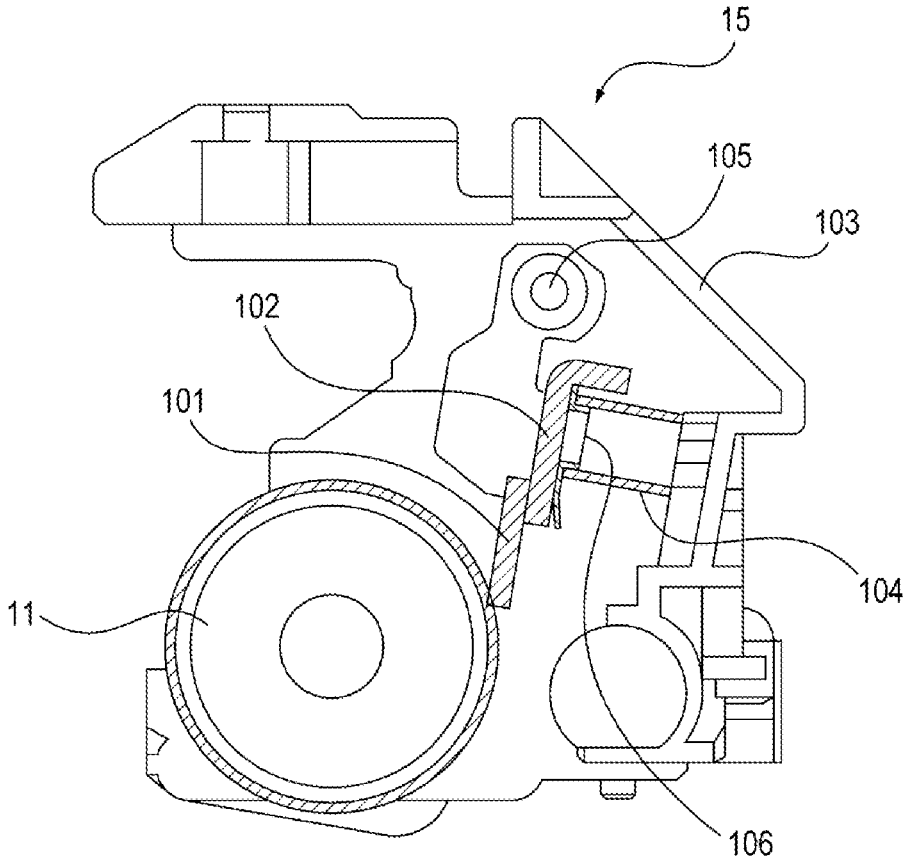
FIG. 1 is a configuration diagram of a cleaning device according to a first embodiment.
Figure 3A:
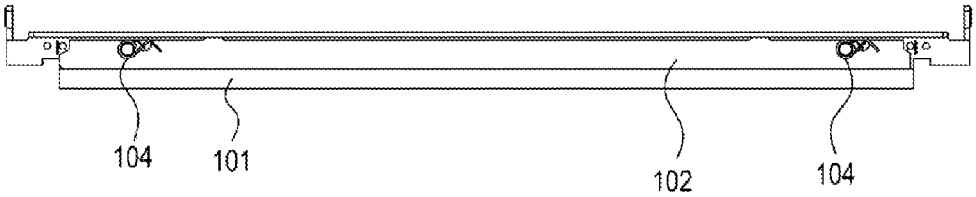
FIG. 3A is a configuration diagram of a cleaning blade and a cleaning blade holding plate according to the first embodiment.

(Cleaning Device 15) FIG. 1 is a configuration diagram of a cleaning device 15 according to the present embodiment. FIG. 3A is a configuration diagram of a cleaning blade (blade) 101 and a holding plate (supporting member) 102 according to the present embodiment.

As illustrated in FIGS. 1 and 3A, the cleaning device 15 includes a cleaning blade 101, a holding plate 102, a cleaning container (opposite member) 103, a compression coil spring (pressurizing member) 104, and a positioning boss (regulating portion (first regulating portion)) 106.

The cleaning blade 101 is stuck to the holding plate 102. The holding plate 102 is mounted in the cleaning container 103 swingably about a swing center 105.

The compression coil spring 104 is provided between the holding plate 102 and the cleaning container 103. The compressed compression coil spring 104 pressurizes the back side of the holding plate 102, and the cleaning blade 101 is pressed against the photosensitive drum 11. Thus, the toner remained in the photosensitive drum 11 is removed.

Figure 3B:
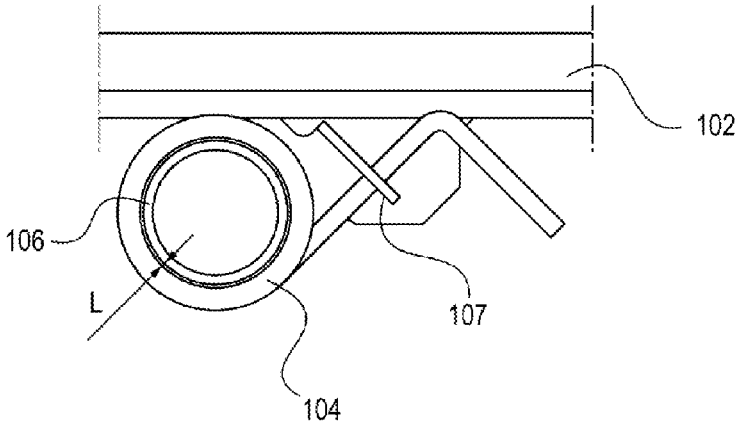
FIG. 3B is a diagram illustrating a relationship of a cleaning blade holding plate, a compression coil spring, and a positioning boss according to the first embodiment.

FIG. 3B is a diagram illustrating a relationship of the holding plate 102, the compression coil spring 104, and the positioning boss 106 according to the present embodiment. As illustrated in FIG. 3B, one end of the compression coil spring 104 is positioned by engagement with the positioning boss 106 provided in the holding plate 102, with a predetermined gap L being provided therebetween. Also, one end of the compression coil spring 104 is hooked and held to a hooking portion (latching member) 107.

That is, since the positioning boss 106 is arranged with the gap L with respect to the compression coil spring 104, the positioning boss 106 allows a movement in a direction perpendicular to a compression direction of the compression coil spring 104. Also, the movement of the compression coil spring 104 is regulated such that the compression coil spring 104 is not moved by more than a predetermined amount in the direction perpendicular to the compression direction of the compression coil spring 104.

By providing the gap L between the compression coil spring 104 and the positioning boss 106, the positioning boss 106 can fix the compression coil spring 104, without disturbing the contraction of the compression coil spring 104. For this reason, not like in the related art, as in a case where the compression coil spring 104 is fixed to the positioning boss 106 by press-fit, there are cases where the pressure is never generated in the engaged portion. Therefore, a desired pressure can be obtained, and a change in the pressure can be suppressed.

Figure 4:
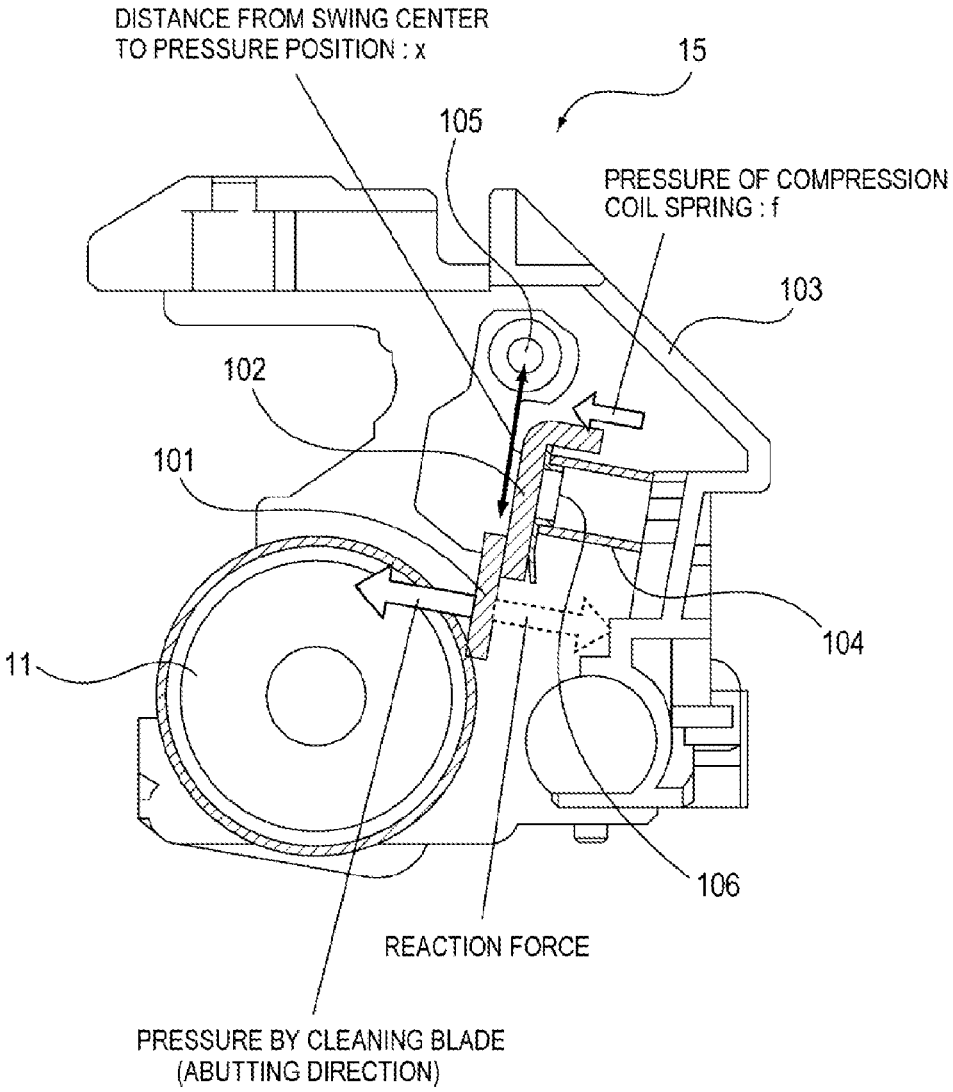
FIG. 4 is a diagram illustrating a relationship of a pressure by a cleaning blade and a reaction force from a photosensitive drum.

FIG. 4 is a diagram illustrating the relationship of the pressure by the cleaning blade 101 and the reaction force from the photosensitive drum 11. As illustrated in FIG. 4, where a pressure of the compression coil spring 104 is f and a distance from the swing center 105 to the pressure position by the compression coil spring 104 is x, the pressure of the cleaning blade 101 with respect to the photosensitive drum 11 is in proportion to the product of f and x.

In the configuration of the present embodiment, the positioning boss 106 is provided in the holding plate 102. In a case where the positioning boss 106 is provided on the cleaning container 103 side, the swing of the holding plate 102 changes the position of the holding plate 102 pressurized by the compression coil spring 104, resulting in a change in the distance x.

According to the configuration of the present embodiment, as compared with the case where the positioning boss 106 is provided on the cleaning container 103 side, the non-uniformity of the pressure f of the compression coil spring 104 occurs equally. However, it is possible to suppress the non-uniformity of the distance x from the swing center 105 to the pressure position by the compression coil spring 104. For this reason, it is advantageous to the stabilization of the pressure by the cleaning blade 101.

Figure 5A:
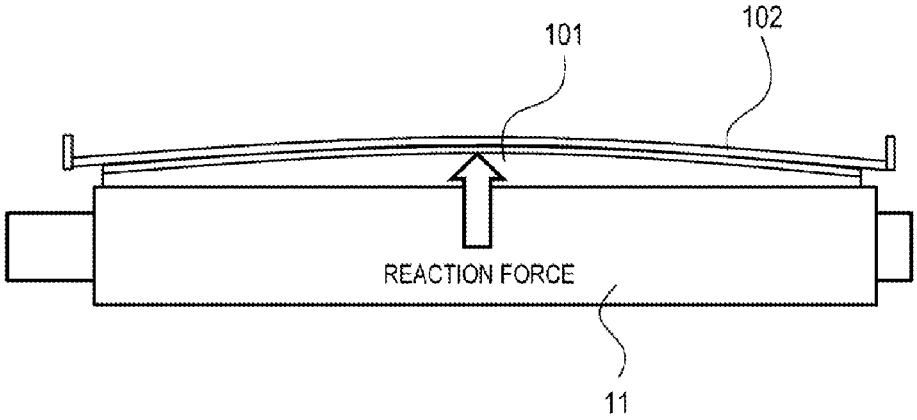
FIG. 5A is a diagram illustrating a pressure state of a cleaning blade.

FIG. 5A is a schematic diagram illustrating a pressure state of the cleaning blade. As described above, the present embodiment is configured such that both longitudinal ends of the holding plate 102 are pressed by the compression coil spring 104, and the cleaning blade 101 is pressurized against the photosensitive drum. In such a configuration, when applying pressure against the photosensitive drum 11, the cleaning blade 101 and the holding plate 102 receive a reaction force from the photosensitive drum 11. Therefore, as illustrated in FIG. 5A, the centers of the cleaning blade 101 and the holding plate 102 are deformed in a direction getting farther away from the photosensitive drum 11.

Figure 5B:
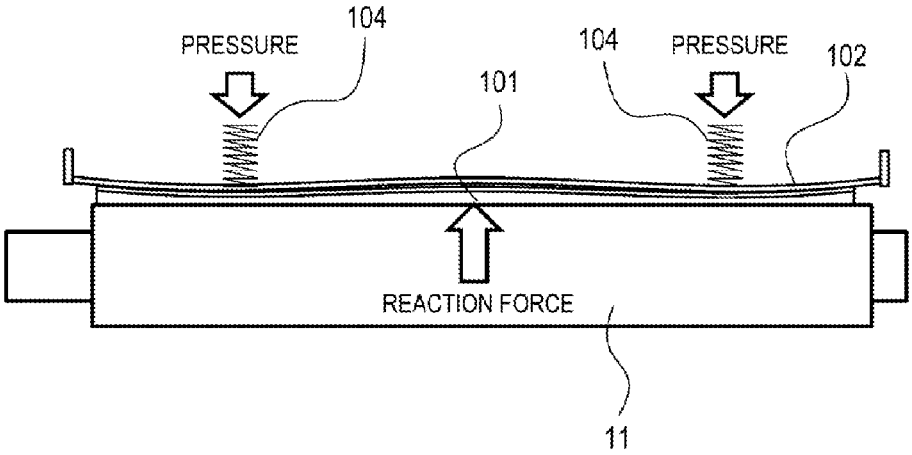
FIG. 5B is a diagrams illustrating a state of a pressure of a cleaning blade and a reaction force.

In the present embodiment, as illustrated in FIG. 4, the pressure direction of the compression coil spring 104 is set to be substantially parallel to an abutting direction in which the cleaning blade 101 abuts against the photosensitive drum 11. Therefore, as illustrated in FIG. 5B, the desired pressure capable of cancelling the deformation of the cleaning blade 101 can be applied. That is, the pressure of the compression coil spring 104 can be applied in a direction opposite to a direction of deformation. Therefore, the pressure of the cleaning blade 101 in the longitudinal direction is made uniform.

Also, the present invention is not limited to the cleaning device 15 which cleans the photosensitive drum 11, and can also be applied to the cleaning device 115 which cleans the intermediate transfer belt 31.

Second Embodiment

Figure 6:
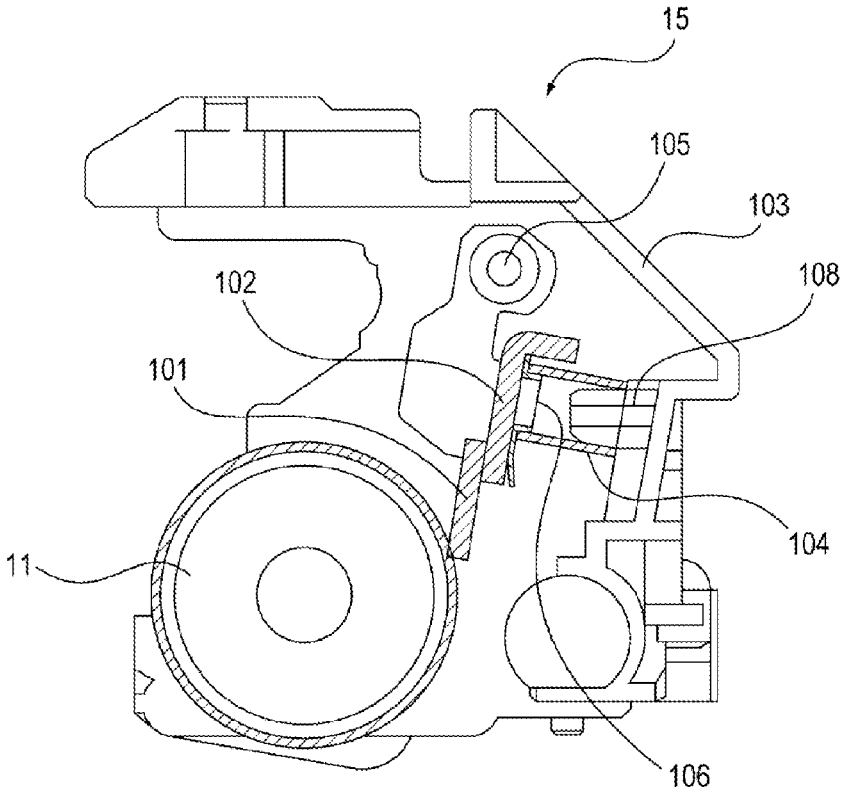
FIG. 6 is a configuration diagram of a cleaning device according to a second embodiment.

Next, a second embodiment of a cleaning device and an image forming apparatus according to the present invention will be described with reference to the drawings. Parts overlapped with the description of the first embodiment are assigned with the same reference numerals, and a description thereof will not be repeated. FIG. 6 is a configuration diagram of the cleaning device 15 according to the present embodiment.

As illustrated in FIG. 6, the cleaning device 15 of the present embodiment includes a positioning boss (second regulating portion) 108 provided on the cleaning container 103 side of the cleaning device 15 of the first embodiment. That is, the positioning boss 108 is provided in an opposite portion facing the holding plate 102, with the compression coil spring 104 being disposed therebetween. The positioning boss 108 is engaged with the other end of the compression coil spring 104 (cleaning container 103 side), with a predetermined gap L being provided between the compression coil spring 104 and the positioning boss 106, and positions the compression coil spring 104.

By providing the positioning boss 108 on the cleaning container 103 side, the posture of the compression coil spring 104 can be more stabilized, contributing to the stabilization of pressure.

Generally, in a case where the positioning bosses are provided at both ends of the compression coil spring, the compression coil spring may ride on the positioning bosses at the time of assembly. For this reason, from the viewpoint of ease of assembly, it is preferable to raise the heights of the positioning bosses to some extent. However, in a case where the heights of both of the two positioning bosses at both ends of the compression coil spring are raised, it is necessary to prevent the leading ends of both of the positioning bosses from coming into contact with each other when the cleaning blade swings. For this reason, the cleaning container becomes larger by at least the positioning height.

Therefore, in the present embodiment, the high positioning boss 108 is provided on the cleaning container 103 side, the low positioning boss 106 is provided on the cleaning blade 101 side, and the positioning bosses 108 and 106 are held using the hooking portion 107. That is, the length relevant to the compression direction of the compression coil spring 104 is shorter on the positioning boss 106 side than on the positioning boss 108 side. Therefore, the cleaning container 103 does not become larger, and the ease of assembly can be ensured.

Also, in the present embodiment, the position of the compression coil spring 104 is regulated by the bosses 106 and 108, but the present invention is not limited thereto. For example, the position of the compression coil spring 104 may be regulated by a cylindrical protrusion which is slightly larger than the outer diameter of the compression coil spring 104. Also, in a case where the outer periphery of the compression coil spring 104 is covered, it is unnecessary to cover the entire outer periphery of the compression coil spring 104. The position of the compression coil spring 104 may be regulated by providing a plurality of protrusions around the compression coil spring 104, as long as the protrusions can regulate the position of the compression coil spring 104.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-012932, filed Jan. 25, 2012, which is hereby incorporated by reference herein in its entirety.

What is claimed is:

1. A cleaning device comprising:

a blade which abuts against an image bearing member bearing a toner image, and removes a toner remained in the image bearing member;

a supporting member which supports the blade;

a cleaning container which swingably supports the supporting member;

a pressurizing member which is compressed to pressurize the supporting member; and a regulating portion which is provided in the supporting member, is arranged to face the pressurizing member, with a predetermined gap being provided therebetween, allows a movement of the pressurizing member in a direction perpendicular to a compression direction of the pressurizing member, and regulates a movement of the pressurizing member such that the pressurizing member is not moved by more than a predetermined amount in the direction perpendicular to the compression direction.

2. The cleaning device according to claim 1, comprising an engaging portion which engages the supporting member with the pressurizing member.

3. The cleaning device according to claim 2, comprising a container side regulating portion which is provided in a region of the cleaning container facing the supporting member, is arranged to face the pressurizing member, with a predetermined gap being provided therebetween, allows a movement in the direction perpendicular to the compression direction, and regulates a position of the pressurizing member such that the pressurizing member is not moved by more than a predetermined amount in the direction perpendicular to the compression direction, wherein the length of the regulating portion is shorter than the length of the container side regulation portion with regard to the compression direction.

4. An image forming apparatus, comprising:

an image bearing member which bears an electrostatic latent image; and a cleaning device of any one of claims 1 to 3 which cleans the image bearing member.

* * * * *